US011493234B2

(12) United States Patent
Gao

(10) Patent No.: US 11,493,234 B2
(45) Date of Patent: Nov. 8, 2022

(54) UNIVERSAL MACHINE CORE COMPONENT WITH INTERCHANGEABLE FUNCTION FOR HEATER AND FAN

(71) Applicant: Tianyu Gao, Shenzhen (CN)

(72) Inventor: Tianyu Gao, Shenzhen (CN)

( * ) Notice: Subject to any disclaimer, the term of this patent is extended or adjusted under 35 U.S.C. 154(b) by 291 days.

(21) Appl. No.: 16/883,919

(22) Filed: May 26, 2020

(65) Prior Publication Data

US 2021/0010716 A1 Jan. 14, 2021

(30) Foreign Application Priority Data

Jul. 9, 2019 (CN) ..... 201910613532.5

(51) Int. Cl.

| | |
|---|---|
| ***F24H 3/00*** | (2022.01) |
| ***F04D 25/06*** | (2006.01) |
| ***F24H 3/04*** | (2022.01) |
| ***F04D 29/42*** | (2006.01) |
| ***F24H 9/18*** | (2022.01) |
| ***F04D 25/08*** | (2006.01) |
| ***F24H 3/02*** | (2022.01) |
| ***F24H 9/00*** | (2022.01) |
| ***F24H 9/1863*** | (2022.01) |

(52) U.S. Cl.

CPC ..... *F24H 3/002* (2013.01); *F04D 25/06* (2013.01); *F04D 25/08* (2013.01); *F04D 29/4226* (2013.01); *F24H 3/02* (2013.01); *F24H 3/04* (2013.01); *F24H 3/0405* (2013.01); *F24H 3/0411* (2013.01); *F24H 3/0482* (2013.01); *F24H 9/0052* (2013.01); *F24H 9/1863* (2013.01)

(58) Field of Classification Search

CPC ..... F04D 25/06; F04D 25/08; F04D 29/4226; F24H 3/002; F24H 3/02; F24H 3/04; F24H 3/0405; F24H 3/0411; F24H 3/0482; F24H 9/0052; F24H 9/1863

See application file for complete search history.

(56) References Cited

U.S. PATENT DOCUMENTS 4,737,616 A * 4/1988 Wen-Ying ..... F24H 9/1872 219/505
2017/0184316 A1* 6/2017 Gao ..... F24F 7/007

* cited by examiner

*Primary Examiner* — Audrey B. Walter
(74) *Attorney, Agent, or Firm* — Novoclaims Patent Services LLC; Mei Lin Wong

(57) ABSTRACT

A machine core component, which is a universal part component for heater and fan manufacture, includes a core housing with a vertical structure having an air inlet at a lower end portion, an air outlet at an upper end portion, and an air duct formed between the air inlet and the air outlet; a driving motor and a wind wheel supported and received inside the core housing; and a heating element mounting window located at the air inlet for quick and easy installation of a heating element so that the machine core component can be used for fan or heater manufacture.

14 Claims, 4 Drawing Sheets

UNIVERSAL MACHINE CORE COMPONENT WITH INTERCHANGEABLE FUNCTION FOR HEATER AND FAN

BACKGROUND OF THE PRESENT INVENTION

Field of Invention

The present invention relates to a machine core component and, more particularly to a machine core component which is a semi-finished product capable of performing function interchange between a heater and a fan.

Description of Related Arts

Nowadays, many different equipment such as such as air conditioners, electric fans, heaters, air-conditioning fans, humidifiers, etc. are used to regulate temperature and humidity. Among them, the electric fan provides nature wind while the heater provides hot air. In terms of function, the heater usually provides hot air but can also provide nature wind when the heating element stops working. Therefore, for a heater, if the heating function of the heating element is removed, the heater can be converted to provide function of an electric fan. Similarly, for the electric fan, by adding the heating function of heating element, the electric fan can be converted to provide function of a heater. However, in the conventional arts, the machine core assemblies of electric fan and heater are completely different. The machine core component of an electric fan cannot be used for a heater while the machine core component of a heater cannot be used for an electric fan. Accordingly, the same type of machine core component cannot be applicable to both an electric fan and a heater. It is also not possible to switch between the function of the heater and the fan by adding or removing the heating element. For processing, this will undoubtedly increase the design costs and mold opening costs of different parts, which is not conducive to batch and modular processing production. If the same machine core component is applicable to both the heater and the fan, the finished product can be switched between the fan function and the heater function, which will definitely save costs and reduce processing difficulties, so it is more suitable for batch processing and production.

SUMMARY OF THE PRESENT INVENTION

An object of the present invention is to solve the above problems and provide a universal machine core component which is universally applicable for both a heater and a fan. The universal machine core component has strong versatility and simple structure which can greatly reduce the manufacturing cost and processing difficulties. The machine core component is a semi-finished product which can also be used for further processing to manufacture finished products with different functions according to the needs and is capable of providing function interchange between a heater and a fan.

Another object of the present invention is to provide a universal machine core component which is a semi-product to facilitate the manufacture of a heater and a fan.

Additional advantages and features of the invention will become apparent from the description which follows, and may be realized by means of the instrumentalities and combinations particular point out in the appended claims.

According to the present invention, the foregoing and other objects and advantages are attained by universal machine core component which is universally applicable for heater and fan manufacture, comprising:

a core housing, which has a vertical structure defining a lower end portion and an upper end portion, having an air inlet at a lower end portion, an air outlet at an upper end portion, forming an air duct along between the air inlet and the air outlet to allow airflow at a bottom-to-top direction;

a driving motor mounted inside the core housing;

a wind wheel coaxially connected to the driving motor and received inside the core housing; and a heating element mounting window located at the air inlet arranged for mounting a heating element selectively so that the machine core component is a machine core component for a fan when the heating element is not installed and the machine core component is a machine core component for a heater when the heating element is installed at the air inlet of the core housing.

The core housing comprises a heating element bracket, an air duct housing and a motor bracket fixedly connected together to form the core housing, wherein the air duct housing has two opposite lateral sides defining a first open side fittingly covered by the heating element bracket and a second side, which is a second open side, fittingly covered by the motor bracket, wherein the air inlet is provided on the heating element bracket; and the air outlet is formed by connecting the air duct housing and the motor bracket together.

The heating element bracket comprises a flat plate portion having a through hole serving as the air inlet, and a protruded portion protruded from the flat plate portion and peripherally surrounding the through hole.

The air duct housing is formed by a vertical air duct portion, a wheel mounting portion and a first outlet casing, wherein the vertical air duct portion has an opening at a first side thereof which is fitting covered by the heating element bracket and another opening at a second side and at the upper end thereof, the wheel mounting portion has a cylindrical body and an axial direction along a horizontal direction, having a first side connected to the second side of the air duct housing at the upper end of the air duct portion and communicated to the air duct portion through the another opening of the air duct portion to allow air passage and an open side opposite to the first side, the first outlet casing is connected to a circumferential side wall of the wheel mounting portion at an upper end of the wheel mounting portion and communicated through the wheel mounting portion.

The motor bracket is formed by a motor cover portion and a second air outlet casing arranged for fitting connecting to the wheel mounting portion and the first air outlet casing respectively, the motor cover portion and the wheel mounting portion are connected together to define an installation compartment which is sized to fit the driving motor and the wind wheel, the first air outlet casing and the second air outlet casing are connected together to form an outlet portion defining an air outlet passage therein and having the air outlet at one proximal end communicate to the installation compartment through the air outlet passage.

The heating element bracket and the air duct portion are connected together to define an air inlet passage therein, and the air inlet passage is communicated through the air inlet.

The driving motor and the wind wheel are installed inside the installation compartment, wherein the wind wheel is received inside the wheel mounting portion having an axial direction parallel to the axial direction of the wheel mounting portion, and the driving motor is installed inside the motor cover portion and has a driving connection with the wind wheel.

A grid element between the wheel mounting portion and the first air outlet casing.

The air duct portion, the wheel mounting portion and the first outlet casing are integrally formed one-piece component.

The motor cover portion and the second air outlet casing are integrally formed one-piece component.

The advantageous effect of the present invention are as follows: The machine core component of the present invention is a semi-finished product which can be switched between fan function and heater function. The machine core component has a vertical configuration with its air inlet at the bottom and its air outlet at the top while a heating element can be easily installed at the air inlet. Therefore, when it is installed with a heating element, it can be used as a machine core component of a heater. When it is not installed with a heating element, it can be used as a machine core component of an electric fan. The machine core component is a core assembly which can provide function exchange between a heater and a fan, and is universal to a fan and a heater and can be used for further processing to manufacture products with different functions according to the needs. It has strong versatility and simple structure. It can greatly reduce the product cost and processing difficulty. It has strong practicality and is suitable for intense promotion.

Still further objects and advantages will become apparent from a consideration of the ensuing description and drawings. These and other objectives, features, and advantages of the present invention will become apparent from the following detailed description, the accompanying drawings, and the appended claims.

Numerical references: 10: core housing; 11: heating element bracket; 111: flat plate portion; 112: protruded portion; 113: through hole; 12: air duct housing; 121: air duct portion; 122: wheel mounting portion; 123: first air outlet casing; 124: grid element; 13: motor bracket; 131: motor cover portion; 132: second air outlet casing; 14: outlet portion; 20: wind wheel; 30: drive motor; 40: air inlet; 50: air outlet; 60: heating element; 70: air inlet passage; 80: air outlet passage; 90: installation compartment.

DETAILED DESCRIPTION OF THE PREFERRED EMBODIMENT

The preferred embodiment of the present invention is further described with the accompanying drawings as follows, which is not intended to be limiting.

Figure 1:
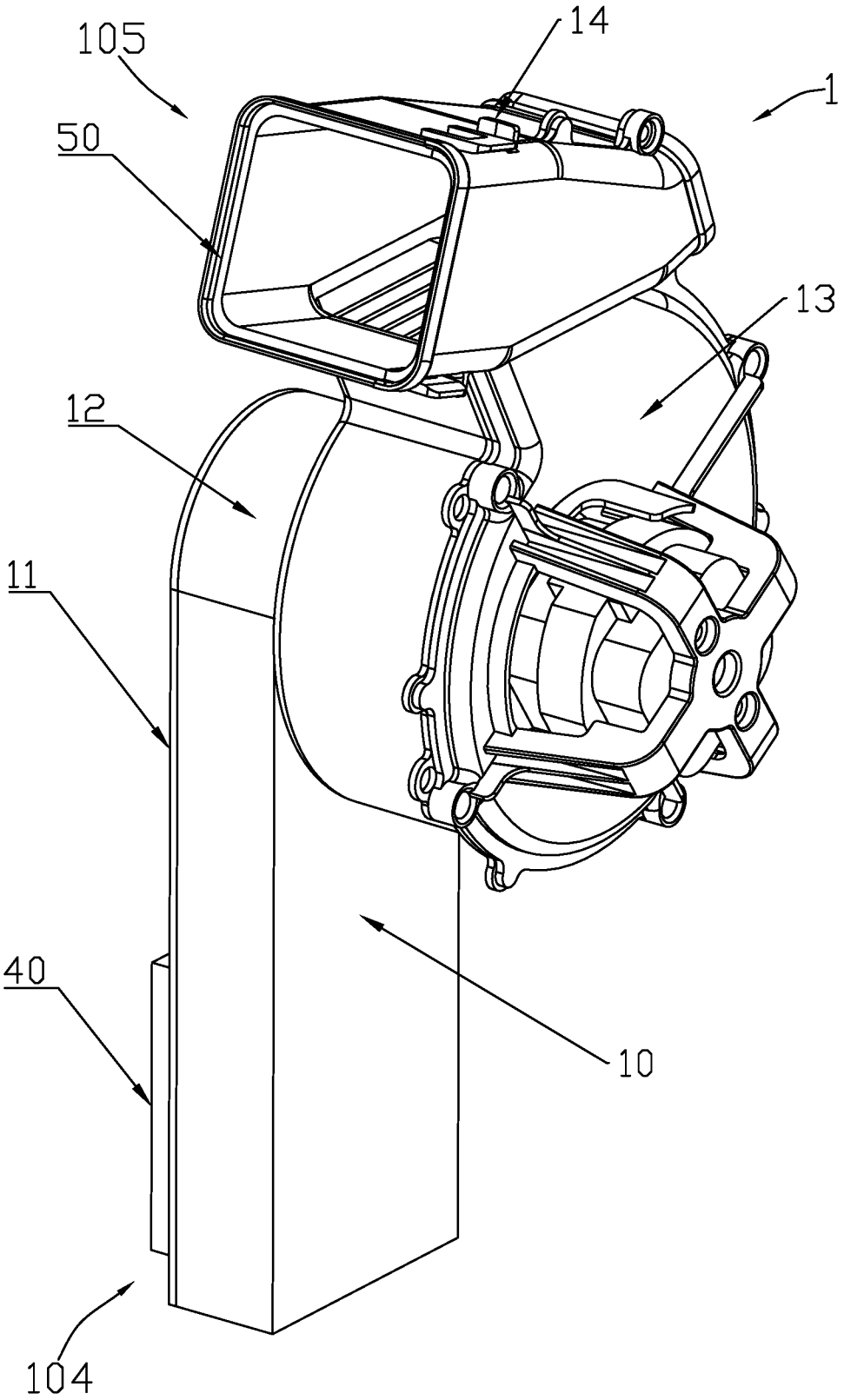
FIG. 1 is perspective view showing an overall structure of a machine core component according to a preferred embodiment of the present invention.
Figure 2:
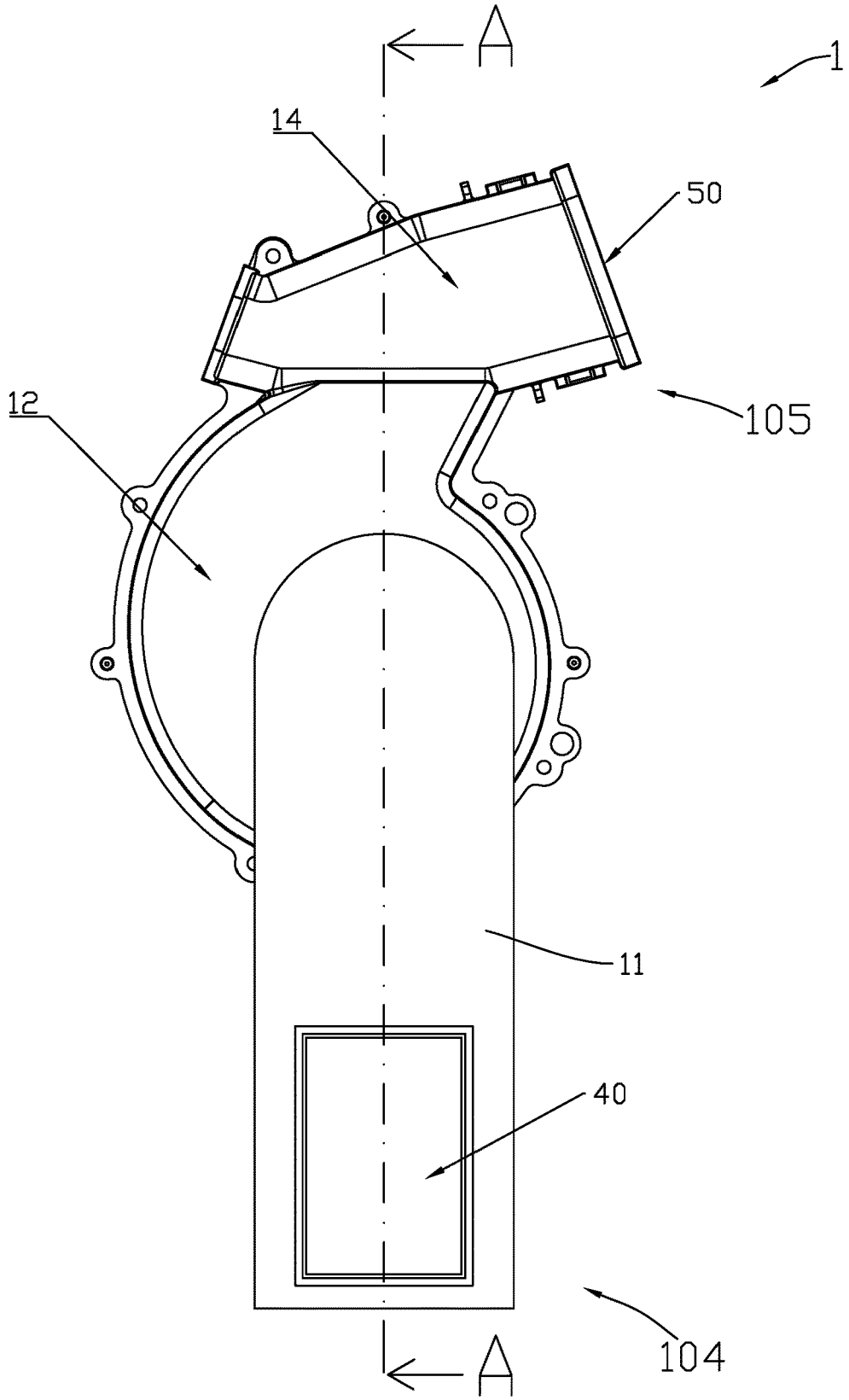
FIG. 2 is a side view illustration of the machine core component according to the above preferred embodiment of the present invention.
Figure 3:
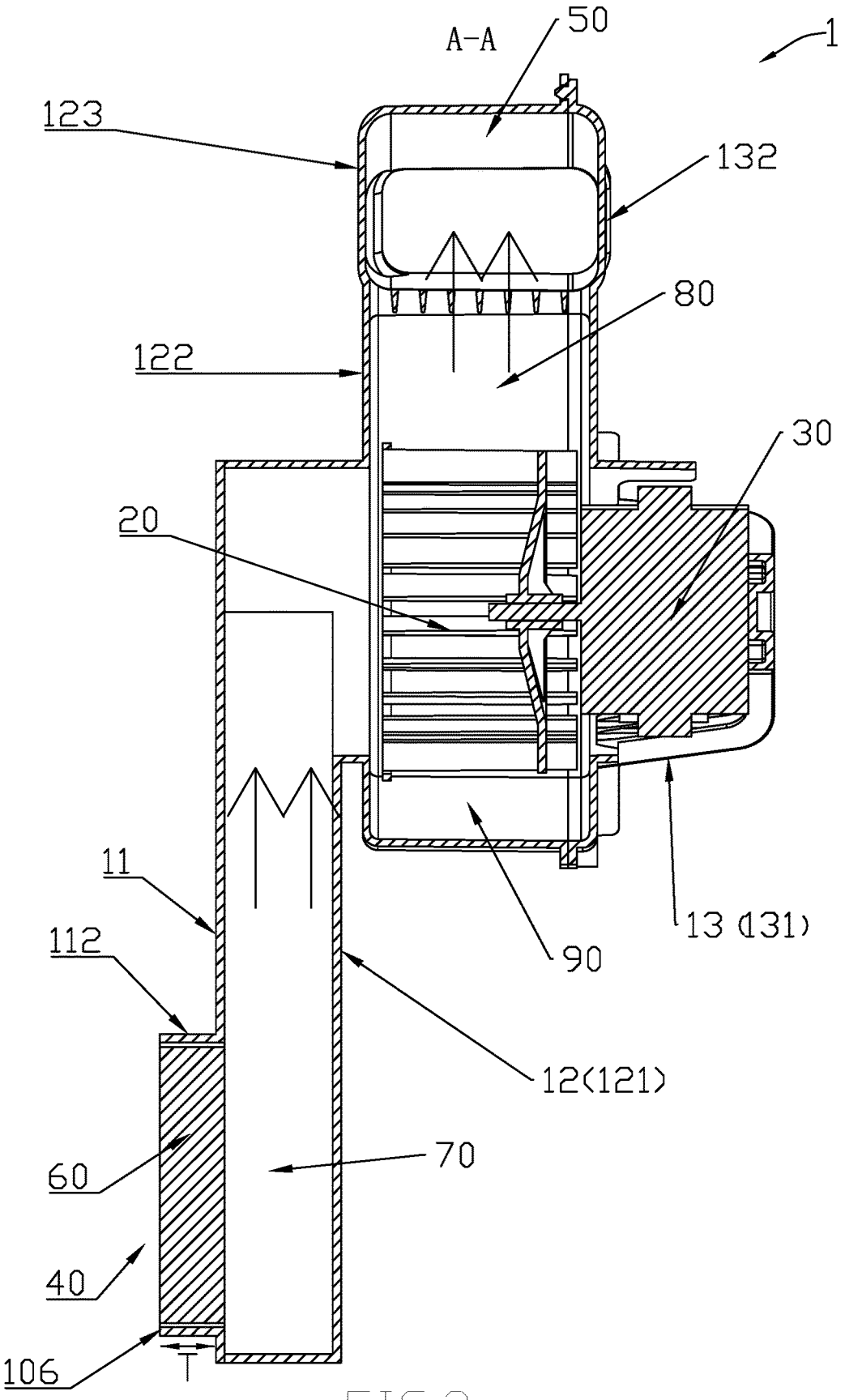
FIG. 3 is a cross-section view of the machine core component according to the above preferred embodiment of the present invention.
Figure 4:
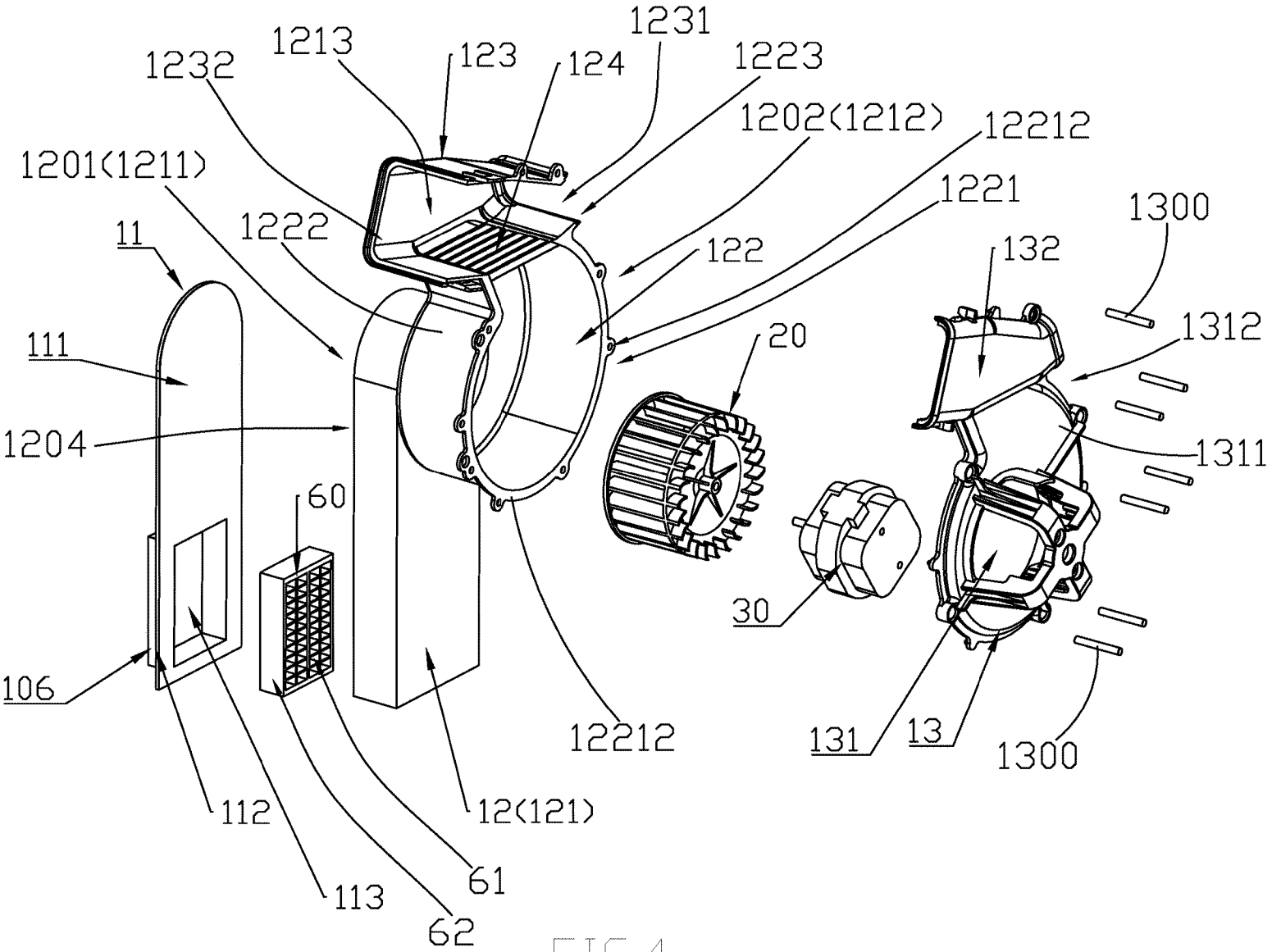
FIG. 4 is an exploded view of the machine core component according to the above preferred embodiment of the present invention.

Referring to FIG. 1 to FIG. 4 of the drawings, the present invention provides a machine core component 1 which is universally applicable for both a heater and a fan. The machine core component 1 comprises a drive motor 30, a wind wheel 20 and a core housing 10. The machine core component 1 also comprises a heating element mounting window 106 for selectively mounting a heating element 60.

The core housing 10 comprises a heating element bracket 11, an air duct housing 12 and a motor bracket 13. The air duct housing 12 has two opposite sides, namely a first sides 1201 and a second side 1202. The heating element bracket 11 is connected to the first side 1201 of and the motor bracket 13 is connected to the second side 1202 of the air duct housing 12.

Specifically, the heating element bracket 11 comprises a flat plate portion 111, a protruded portion 112 and a through hole 113. The flat plate portion 111 and the protruded portion 112 are integrally formed. The protruded portion 112 is protruded from the flat plate portion 111. The protruded portion 112 has a shape which may be set according to requirements. According to this preferred embodiment, the protruded portion 112 has a rectangular shape. The through hole 113 is arranged on the flat plate portion 111. The through hole 113 penetrates from one side of the flat plate portion 111 along the thickness of the flat plate portion 111 to the end surface of the protruded portion 112, thereby forming an air inlet 40 of the core housing 10. The air inlet 40 has a shape which may be set according to requirements. According to this preferred embodiment, the air inlet 40 has a rectangular shape. Since the air inlet 40 has a certain thickness T, the air inlet 40 can be used to install a heating element 60. Accordingly, by selectively adding or removing the heating element 60, the machine core component 1 with different functions can be provided.

When the machine core component 1 is used as a core component of a heater, the heating element 60 can be installed at the air inlet 40. For example, the heating element 60 is an electric heating wire mounted at the air inlet 40 through the protruded portion 112.

Specifically, the heating element 60 has a peripheral side 62 arranged to match the protruded portion 112 for installation and comprises a grid structure with a plurality of passage through-holes 61 to allow air passage of the air inlet 40. In other words, after the heating element 60 is inserted into the through hole 113 and support through the protruded portion 112 on the heating element bracket 11, air passage from the air inlet 40 will pass through the passage through-holes 61 of the heating element to enter into the air duct housing 12.

The air duct housing 12 comprises a vertical air duct portion 121, a wheel mounting portion 122 and a first air outlet casing 123. According to this preferred embodiment, the vertical air duct portion 121, the wheel mounting portion 122 and the first air outlet casing 123 are integrally formed. Alternately, the vertical air duct portion 121, the wheel mounting portion 122 and the first air outlet casing 123 are integrally connected together.

The vertical air duct portion 121 has a rectangular box shape and has an opening 1204 at a first side 1211. The heating element bracket 11 is fittingly connected to the vertical air duct portion 121 to close the opening 1204 at the first side 1211 such that an air inlet passage 70 is formed between the heating element bracket 11 and the air duct portion 121. The air inlet passage 70 has one end communicated through the air inlet 40 and another end communicated through the wheel mounting portion 122. Therefore, air entering from the air inlet 40 can be guided to flow through the air inlet passage 70 to the wheel mounting portion 122.

Referring to FIG. 1-4 of the drawings, the wheel mounting portion 122 is positioned at an upper end 1213 of the air duct portion 121 and has a cylindrical body defining an open side 1221 opposite to a connecting side which connects to the air duct portion 121. The wheel mounting portion 122 and the heating element bracket 11 are positioned at the two opposite sides 1211, 1212 of the air duct portion 121. The wheel mounting portion 122 is connected to the air duct portion 121 and is communicated through the inside of the air duct portion 121. The wheel mount portion 122 has an axial direction along a horizontal direction, and the wind wheel 20 is mounted along the axial direction along the horizontal direction of the wheel mounting portion 122. In order to facilitate the mounting of the motor bracket 13, the open side of the wheel mount portion 122 comprises a plurality of mounting holes 12212 at a peripheral 12211 of the open side 1221 for connecting the motor bracket 13 into position securely by fasteners 1300 such as screws.

The first air outlet casing 123 is connected to and positioned at a circumferential side wall 1222 of the wheel mounting portion 122 and at an upper end 1223 of the wheel mounting portion 122. The first air outlet casing 123 has an open side 1231 at a side facing the motor bracket 13; and has another one or two open ends 1232 facing a radial direction of the wheel mounting portion 122. The first air outlet casing 123 is connected to the motor bracket 13 to form an air outlet passage 80.

The motor bracket 13 comprises a motor cover portion 131 and a second air outlet casing 132. According to this embodiment, the motor cover portion 131 and the second air outlet casing 132 are integrally formed. Alternately, the motor cover portion 131 and the second air outlet casing 132 can be integrally connected together.

The motor cover portion 131 is used to cover the driving motor 30 and secure the driving motor 30 into position. The motor cover portion 131 has a dome shape and is mated to connect with the wheel mounting portion 122. According to this embodiment, the motor cover portion 131 and the wheel mounting portion 122 are connected by fasteners 1300 such as screws. In other embodiments, the motor cover portion 131 and the wheel mounting portion 122 can be connected together by other connecting elements. The motor cover portion 131 and the wheel mounting portion 122 defines an installation compartment 90 which is used for installing the wind wheel 20 and the driving motor 30 inside the installation compartment 90.

The second air outlet casing 132 is positioned on a circumferential side wall 1311 of the motor cover portion 131 and at an upper end 1312 of the motor cover portion 131. The second air outlet casing 132 is formed by bending and extending a side wall portion of the motor cover portion 131. The second air outlet casing 132 and the first air outlet casing 123 are connected together to form an outlet portion 14. According to this embodiment, the second air outlet casing 132 and the first air outlet casing 123 are connected together by fasteners 1300 such as screws and bolts. In other embodiments, the second air outlet casing 132 and the first air outlet casing 123 can also be connected together by using snap and click elements. The outlet portion 14 has a hollow body defining the air outlet passage 80 therein. The air outlet passage 80 communicates through with the installation compartment 90. The outlet portion 14 has an open end to define the air outlet 50. The air outlet 50 communicates through with the air outlet passage 80.

In order to facilitate air passage, a grid element 124 is provided between the air outlet passage 80 and the installation compartment 90. According to this embodiment, the grid element 124 is arranged between the first air outlet casing 123 and the wheel mounting portion 122. After the air duct housing 12 and the motor bracket 13 are connected together, the grid element 124 is provided between the air outlet passage 80 and the installation compartment 90.

The outlet portion 14 may have a shape according to the actual requirements. The outlet portion 14 can output the air after changing an air output direction inside the wheel mounting portion 122. For examples, the outlet portion 14 can output the air at a horizontal direction, at a slanted upward direction or at a slanted downward direction, which can be set according to a height of the finished product.

Referring to FIG. 1 to FIG. 4 of the drawings, the wind wheel 20 is used to create an air flow to produce a wind blowing effect. The wind wheel 20 may be a centrifugal wind wheel which has an air output volume along the blades. The wind wheel 20 is horizontally mounted inside the wheel mounting portion 122 and has an axis direction parallel to the axial direction of the wheel mounting portion 122. The wind wheel 20 is coaxially connected with the output shaft of the driving motor 30 and rotates under the driving action of the driving motor 30. The driving motor 30 is configured to drive the wind wheel 20 and a conventional driving motor may be used. The driving motor 30 is horizontally installed in the motor bracket 13 and is positioned between the motor cover portion 131 and the wind wheel 20. The driving motor 30 is coaxial with the wind wheel 20. The driving motor 30 and the wind wheel 20 are connected together by drive connection.

Referring to FIG. 1 to FIG. 4 of the drawings, the core housing 10 is formed by the heating element bracket 11, the air duct housing 12 and the motor bracket 13. The machine core component 1 is formed by the core housing 10, the wind wheel 20 and the driving motor 30. The machine core component 1 has a vertical structure as a whole defining an upper end portion 105 and a lower end portion 104 which are provided with the air outlet 50 and the air inlet 40 respectively. This vertical structure allows air intake from the lower end portion 104 to flow at an upward direction to exit from the upper portion 105. Compared with a non-vertical structure, which allows air intake from a front side and air exit at an opposite rear side, the vertical structure utilizes airflow design at a bottom-to-top direction. Also, the air inlet passage 70 and the air outlet passage 80 are arranged for providing air circulation. The wind wheel 20 is arranged between the air inlet passage 70 and the air outlet passage 80. When the wind wheel 20 is driven by the driving motor 30, the wind entering from the air inlet 40 is directed to flow to the air outlet 50 by the wind wheel 20, thereby forming a blowing effect at the air outlet 50. Since the air inlet 40 of the machine core component 1 can be used for installing the heating element 60, the machine core component 1 can form a core assembly for a heater and output hot air at the air outlet 50 when the heating element 60 is installed at the air inlet 40, or the machine core component 1 can form a core assembly for a fan and output natural wind at the air outlet 50 when the heating element 60 is not installed at the air inlet 40. The machine core component of the present invention, which can exchange functions between a heater and a fan, is suitable for a heater and a fan. It has strong versatility and convenient function switching. It can be easily manufactured with different functions according to different needs and has a very strong practicality.

One skilled in the art will understand that the embodiment of the present invention as shown in the drawings and described above is exemplary only and not intended to be limiting.

It will thus be seen that the objects of the present invention have been fully and effectively accomplished. Its embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A machine core component which is universally applicable for heater and fan manufacture, comprising:

a core housing, which has a vertical structure defining a lower end portion and an upper end portion, having an air inlet at said lower end portion, an air outlet at said upper end portion, forming an air duct between said air inlet and said air outlet;

a driving motor mounted inside said core housing;

a wind wheel coaxially connected to said driving motor and received inside said core housing; and a heating element mounting window located at said air inlet arranged for mounting a heating element selectively so that said machine core component is a machine core component for a fan when the heating element is not installed and said machine core component is a machine core component for a heater when the heating element is installed at said air inlet of said core housing, wherein said core housing comprises a heating element bracket, an air duct housing and a motor bracket fixedly connected together to form said core housing, wherein said air duct housing has two opposite lateral sides defining a first open side fittingly covered by said heating element bracket and a second side, which is a second open side, fittingly covered by said motor bracket, wherein said air inlet is provided on said heating element bracket; and said air outlet is formed by connecting said air duct housing and said motor bracket together, wherein said air duct housing is formed by a vertical air duct portion, a wheel mounting portion and a first outlet casing, wherein said vertical air duct portion has an opening at a first side thereof which is fitting covered by said heating element bracket and another opening at a second side and at the upper end thereof, said wheel mounting portion has a cylindrical body and an axial direction along a horizontal direction, having a first side connected to the second side of said air duct housing at the upper end of said air duct portion and communicated to said air duct portion through said another opening of said air duct portion to allow air passage and an open side opposite to said first side of said wheel mounting portion, said first outlet casing is connected to a circumferential side wall of said wheel mounting portion at an upper end of the wheel mounting portion and communicated through said wheel mounting portion.

2. The machine core component which is universally applicable for heater and fan manufacture according to claim 1, wherein said heating element bracket and said air duct portion are connected together to define an air inlet passage therein, and said air inlet passage is communicated through said air inlet.

3. The machine core component which is universally applicable for heater and fan manufacture according to claim 1, wherein said air duct portion, said wheel mounting portion and said first outlet casing are integrally formed one-piece component.

4. The machine core component which is universally applicable for heater and fan manufacture according to claim 1, wherein said motor cover portion and said second air outlet casing are integrally formed one-piece component.

5. The machine core component which is universally applicable for heater and fan manufacture according to claim 1, wherein said motor bracket is formed by a motor cover portion and a second air outlet casing arranged for fitting connecting to said wheel mounting portion and said first air outlet casing respectively, said motor cover portion and said wheel mounting portion are connected together to define an installation compartment which is sized to fit said driving motor and said wind wheel, said first air outlet casing and said second air outlet casing are connected together to form an outlet portion defining an air outlet passage therein and having said air outlet at one proximal end communicate to said installation compartment through said air outlet passage.

6. The machine core component which is universally applicable for heater and fan manufacture according to claim 5, wherein said driving motor and said wind wheel are installed inside said installation compartment, wherein said wind wheel is received inside said wheel mounting portion having an axial direction parallel to the axial direction of the wheel mounting portion, and said driving motor is installed inside said motor cover portion and has a driving connection with said wind wheel.

7. The machine core component which is universally applicable for heater and fan manufacture according to claim 5, further comprising a grid element between said wheel mounting portion and said first air outlet casing.

8. A machine core component which is universally applicable for heater and fan manufacture, comprising:

a core housing, which has a vertical structure defining a lower end portion and an upper end portion, having an air inlet at said lower end portion, an air outlet at said upper end portion, forming an air duct between said air inlet and said air outlet;

a driving motor mounted inside said core housing;

a wind wheel coaxially connected to said driving motor and received inside said core housing; and a heating element mounting window located at said air inlet arranged for mounting a heating element selectively so that said machine core component is a machine core component for a fan when the heating element is not installed and said machine core component is a machine core component for a heater when the heating element is installed at said air inlet of said core housing, wherein said core housing comprises a heating element bracket, an air duct housing and a motor bracket fixedly connected together to form said core housing, wherein said air duct housing has two opposite lateral sides defining a first open side fittingly covered by said heating element bracket and a second side, which is a second open side, fittingly covered by said motor bracket, wherein said air inlet is provided on said heating element bracket; and said air outlet is formed by connecting said air duct housing and said motor bracket together, wherein said heating element bracket comprises a flat plate portion having a through hole serving as said air inlet, and a protruded portion protruded from said flat plate portion and peripherally surrounding said through hole, wherein said air duct housing is formed by a vertical air duct portion, a wheel mounting portion and a first outlet casing, wherein said vertical air duct portion has an opening at a first side thereof which is fitting covered by said heating element bracket and another opening at a second side and at the upper end thereof, said wheel mounting portion has a cylindrical body and an axial direction along a horizontal direction, having a first side connected to the second side of said air duct housing at the upper end of said air duct portion and communicated to said air duct portion through said another opening of said air duct portion to allow air passage and an open side opposite to said first side of said wheel mounting portion, said first outlet casing is connected to a circumferential side wall of said wheel mounting portion at an upper end of the wheel mounting portion and communicated through said wheel mounting portion.

9. The machine core component which is universally applicable for heater and fan manufacture according to claim 8, wherein said motor bracket is formed by a motor cover portion and a second air outlet casing arranged for fitting connecting to said wheel mounting portion and said first air outlet casing respectively, said motor cover portion and said wheel mounting portion are connected together to define an installation compartment which is sized to fit said driving motor and said wind wheel, said first air outlet casing and said second air outlet casing are connected together to form an outlet portion defining an air outlet passage therein and having said air outlet at one proximal end communicate to said installation compartment through said air outlet passage.

10. The machine core component which is universally applicable for heater and fan manufacture according to claim 9, wherein said heating element bracket and said air duct portion are connected together to define an air inlet passage therein, and said air inlet passage is communicated through said air inlet.

11. The machine core component which is universally applicable for heater and fan manufacture according to claim 10, wherein said driving motor and said wind wheel are installed inside said installation compartment, wherein said wind wheel is received inside said wheel mounting portion having an axial direction parallel to the axial direction of the wheel mounting portion, and said driving motor is installed inside said motor cover portion and has a driving connection with said wind wheel.

12. The machine core component which is universally applicable for heater and fan manufacture according to claim 10, further comprising a grid element between said wheel mounting portion and said first air outlet casing.

13. The machine core component which is universally applicable for heater and fan manufacture according to claim 12, wherein said air duct portion, said wheel mounting portion and said first outlet casing are integrally formed one-piece component.

14. The machine core component which is universally applicable for heater and fan manufacture according to claim 12, wherein said motor cover portion and said second air outlet casing are integrally formed one-piece component.

* * * * *